US007204216B2

(12) United States Patent
Ezaki

(10) Patent No.: US 7,204,216 B2
(45) Date of Patent: Apr. 17, 2007

(54) VARIABLE VALVE MECHANISM

(75) Inventor: Shuichi Ezaki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/091,389

(22) Filed: Mar. 29, 2005

(65) Prior Publication Data

US 2005/0241598 A1 Nov. 3, 2005

(30) Foreign Application Priority Data

Apr. 28, 2004 (JP) ..... 2004-132564
Feb. 2, 2005 (JP) ..... 2005-026682

(51) Int. Cl.
*F01L 1/34* (2006.01)

(52) U.S. Cl. ..... 123/90.16; 123/90.15; 123/90.39; 123/90.43

(58) Field of Classification Search ..... 123/90.15, 123/90.16, 90.39, 90.43, 90.44, 90.45
See application file for complete search history.

(56) References Cited

U.S. PATENT DOCUMENTS 6,425,357 B2 * 7/2002 Shimizu et al. ..... 123/90.16

FOREIGN PATENT DOCUMENTS

JP A 7-63023 3/1995
JP A 7-293216 11/1995
JP A 2003-239712 8/2003

* cited by examiner

*Primary Examiner*—Thomas Denion
*Assistant Examiner*—Zelalem Eshete
(74) *Attorney, Agent, or Firm*—Oliff & Berridge, PLC

(57) ABSTRACT

The present invention includes a rocker arm 16, which has an arm roller 18 at the center, a lash adjuster 30 for supporting a fulcrum P of the rocker arm 16, an oscillation arm 20, which has an oscillation cam surface (a non-pushing section 24 and a pushing section 26) that is in contact with the arm roller 18, and an adjustment mechanism for changing the reference arm rotation angle of the oscillation arm 20 in relation to the rocker arm 16 with a view toward changing the operating angle and lift amount of a valve disc 12 within a predetermined adjustment range. The adjustment mechanism includes a control shaft 22, a roller contact surface 32, a control arm 34, and an oscillation roller arm 38. The lash adjuster 30 is positioned so that its expansion/contraction direction is substantially parallel to a virtual straight line joining the rotation center Q of the oscillation arm 20 to the rotation center S of the arm roller 18.

4 Claims, 7 Drawing Sheets

*: Permissible operating angle variation values

*:Permissible operating angle variation values

VARIABLE VALVE MECHANISM

BACKGROUND OF THE INVENTION

1. Field of the Invention

The present invention relates to a variable valve mechanism, and more particularly to an internal combustion engine's variable valve mechanism that is capable of changing the operating angle and/or lift amount of a valve disc, which opens/closes in synchronism with camshaft rotation.

2. Background Art

The variable valve mechanism disclosed, for instance, by Japanese Patent Laid-open No. 2003-239712 includes a mechanism that is positioned between a cam and a valve disc to change the operating angle and lift amount of the valve disc. This variable valve mechanism has an oscillation arm, which oscillates in synchronism with cam operation, and a rocker arm, which is provided with an arm roller that comes into contact with the oscillation arm. One end of the rocker arm is in contact with the end of a valve stem, and the other end is supported by a lash adjuster. The rocker arm is configured so as to turn in coordination with an oscillation arm's oscillation operation while using a rocker arm end, which is supported by the lash adjuster, as a fulcrum. This variable valve mechanism also includes an adjustment mechanism that changes an oscillation arm's reference arm rotation angle in accordance with a change in the rotation position of a control shaft.

When the reference arm rotation angle of the oscillation arm changes in accordance with a change in the control shaft rotation position, the point of contact between the oscillation arm and arm roller in the above conventional variable valve mechanism changes. When the point of contact changes, a change occurs in the timing with which the rocker arm depresses the valve disc in accordance with a cam operation and in the amount of valve disc depression. Therefore, the above conventional variable valve mechanism can continuously change the operating angle and lift amount of the valve disc by controlling the control shaft rotation position.

Including the above-mentioned document, the applicant is aware of the following documents as a related art of the present invention.

[Patent Document 1]

Japanese Patent Laid-open No. 2003-239712

[Patent Document 2]

Japanese Patent Laid-open No. Hei 7-293216

[Patent Document 3]

Japanese Patent Laid-open No. Hei 7-63023

However, when the lash adjuster, which is positioned at the fulcrum of the rocker arm of the above conventional mechanism, expands/contracts, the fulcrum of the rocker arm moves in the direction of expansion/contraction. Consequently, the point of contact between the oscillation arm and arm roller may change. If the point of contact changes, a change occurs, as described earlier, in the timing with which the rocker arm depresses the valve disc in accordance with a cam operation and in the amount of valve disc depression. In other words, when the lash adjuster expands/contracts to provide zero tappet clearance, an unexpected change may occur in the operating angle and lift amount of the valve disc.

SUMMARY OF THE INVENTION

The present invention has been made to solve the above problems and provides a variable valve mechanism that is capable of avoiding an unexpected change in the operating angle and/or lift amount of the valve disc when the lash adjuster expands/contracts.

The above object is achieved by a variable valve mechanism which includes a rocker arm, one end of which is in contact with a non-valve-disc lateral end of a valve stem, the other end of which functions as a fulcrum, and the central portion of which is provided with an arm roller. A lash adjuster that expands and contracts to provide zero tappet clearance and is positioned to support the fulcrum of said rocker arm is provided. An oscillation arm that has an oscillation cam surface for coming into contact with the arm roller and oscillates in synchronism with the rotation of a cam, thereby transmitting the pressure of the cam to the rocker arm is further provided. An adjustment mechanism for changing the reference arm rotation angle of the oscillation arm in relation to the rocker arm with a view toward changing the operating angle and/or lift amount of a valve disc within a predetermined adjustment range is further provided. The axis line of the lash adjuster is substantially parallel to a virtual straight line that joins the rotation center of the oscillation arm to the rotation center of the arm roller.

Other objects and further features of the present invention will be apparent from the following detailed description when read in conjunction with the accompanying drawings.

BEST MODE OF CARRYING OUT THE INVENTION

First Embodiment

[Configuration of a Variable Valve Mechanism]

Figure 1:
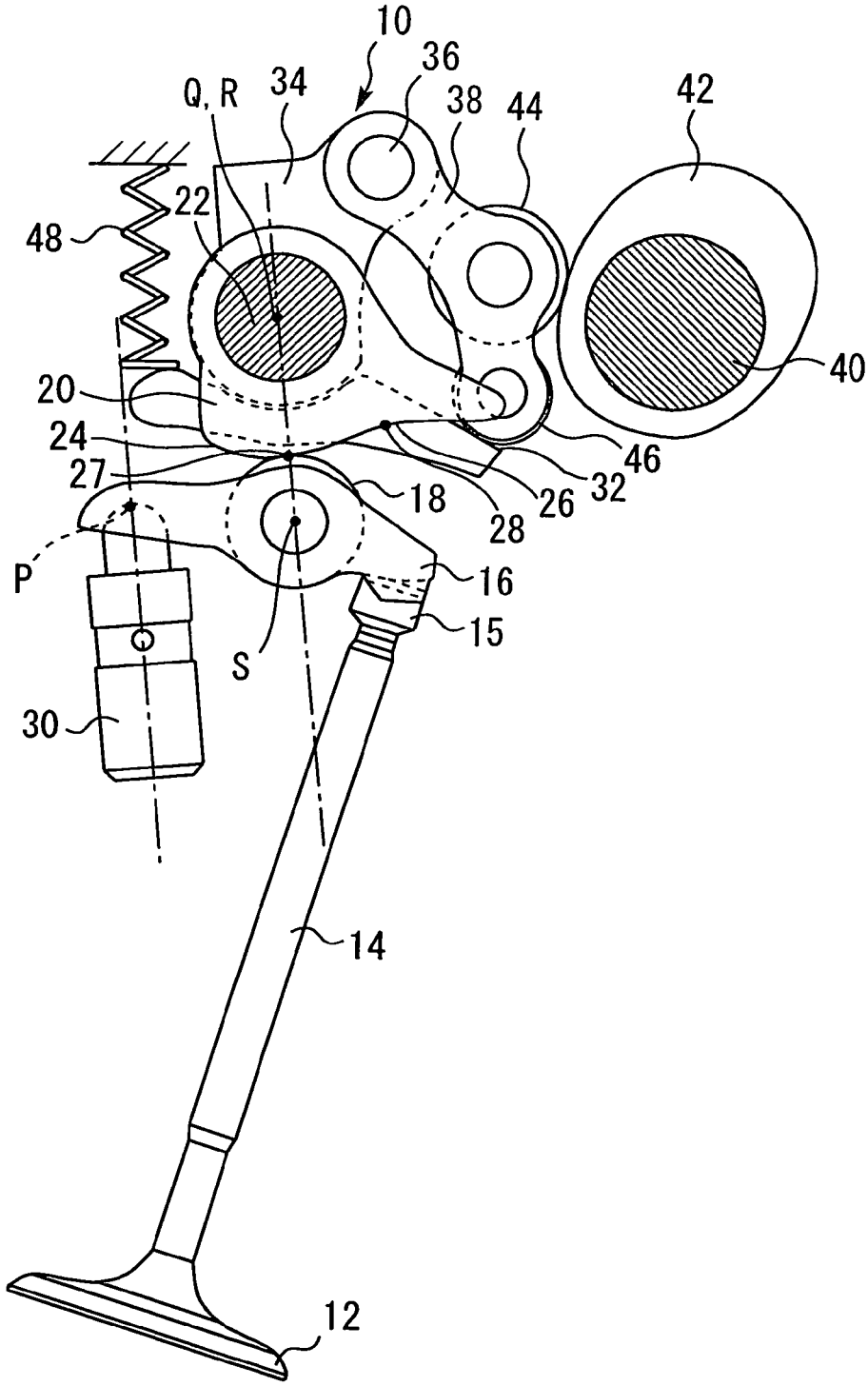
FIG. 1 illustrates the configuration of a variable valve mechanism according to a first embodiment of the present invention.

FIG. 1 illustrates the configuration of a variable valve mechanism 10 according to a first embodiment of the present invention. The variable valve mechanism shown in FIG. 1 drives an internal combustion engine's valve disc that functions as an intake valve or exhaust valve.

The configuration shown in FIG. 1 includes the valve disc 12, which functions as an intake valve or exhaust valve. A valve stem 14 is fastened to the valve disc 12. The non-valve-disc lateral end of the valve stem 14 is covered with a stem end cap 15. The end of the valve stem 14 is in contact with one end of a rocker arm 16 via the stem end cap 15. The center portion of the rocker arm 16 is provided with an arm roller 18.

An oscillation arm 20 (oscillation member) is positioned above the arm roller 18. The oscillation arm 20 is retained by a control shaft 22 in such a manner as to permit oscillation arm rotation. An oscillation cam surface is formed on the oscillation arm 20 as a surface that comes into contact with the arm roller 18. The oscillation cam surface comprises a non-pushing section (non-pushing surface) 24 and a pushing section 26. The non-pushing section (non-pushing surface) 24 is formed so that the distance from the rotation shaft center Q of the oscillation arm 20, that is, the distance from the axial center Q of the control shaft 22, is constant. The pushing section 26 is formed so that the distance from the axial center of the control shaft 22 increases with an increase in the distance from the non-pushing section 24. In other words, the non-pushing surface 24 is formed to have a fixed curvature so that the axial center Q of the control shaft 22 (the rotation center Q of the oscillation arm 20) is the curvature center Q. The point of contact between the arm roller 18 and oscillation arm 20 is hereinafter referred to as a roller contact point 27. A boundary point between the non-pushing section 24 and pushing section 26 is hereinafter referred to as a lift start point 28.

The other end of the rocker arm 16 is supported by a lash adjuster 30. The rocker arm 16 can turn while using the end supported by the lash adjuster 30 as a fulcrum P. The lash adjuster 30 is capable of expanding/contracting to provide zero tappet clearance. In the variable valve mechanism 10 according to the present embodiment, the expansion/contraction direction (axis line) of the lash adjuster 30 is parallel to a virtual straight line (see FIG. 1) that joins the rotation center Q of the oscillation arm 20, that is, the axial center Q of the control shaft 22, to the rotation center S of the arm roller 18. As described above, the mechanism according to the present embodiment is such that the rotation center Q of the oscillation arm 20 is the same as the curvature center R of the non-pushing surface 24. In other words, the axis line of the lash adjuster 30 according to the present embodiment is parallel to a virtual straight line that joins the curvature center R of the non-pushing surface 24 to the rotation center S of the arm roller 18 as viewed in the direction of the axis of the control shaft 22.

The control shaft 22 is secured to a fastener for a cylinder head or the like via a bearing (not shown). An actuator (not shown) is coupled to the control shaft 22. It is assumed that the actuator can rotate the control shaft 22 within a predetermined angular range.

Further, a roller contact surface 32 is retained by the control shaft 22 in such a manner as to permit roller contact surface rotation. The roller contact surface 32 is configured so as to rotate around the control shaft 22 together with the oscillation arm 20. A control arm 34 is attached to the control shaft 22. The control arm 34 is provided with a through-hole. The control shaft 22 and control arm 34 are integrated into a single assembly by the use of a fastener (not shown) while the control shaft 22 is inserted in the through-hole. The control arm 34 is provided with a rotation shaft 36, which is placed at a position that protrudes in the direction of the diameter of the control shaft 22. An oscillation roller arm 38 is retained by the rotation shaft 36 in such a manner as to permit oscillation roller arm rotation.

The oscillation roller arm 38 has a cam contact roller 44 and a slide roller 46. The cam contact roller 44 is in contact with a cam 42 that is fastened to a camshaft 40. The slide roller 46 is in contact with the roller contact surface 32. The cam contact roller 44 and the slide roller 46 can freely turn while they are retained by the oscillation roller arm 38.

The variable valve mechanism 10 includes a lost motion spring 48. The lost motion spring 48 works on a trailing end of the roller contact surface 32 while its upper end is fastened to the cylinder head or the like. The force exerted by the lost motion spring 48 causes the roller contact surface 32 to push the slide roller 46 upward and presses the cam contact roller 44 against the cam 42. Consequently, the variable valve mechanism 10 is maintained so that the cam 42 is mechanically coupled to the roller contact surface 32.

As such being the case, when a cam nose presses the cam contact roller 44 during the rotation of the cam 42, the resulting force is transmitted to the roller contact surface 32 via the slide roller 46. While rolling on the roller contact surface 32, the slide roller 46 can continuously transmit the force applied by the cam 42 to the oscillation arm 20. As a result, the oscillation arm 20 rotates around the control shaft 22, thereby pushing the rocker arm 16 downward and moving the valve disc 12 in the valve opening direction. As described above, the variable valve mechanism 10 can operate the valve disc 12 by transmitting the force of the cam 42 to the roller contact surface 32 via the cam contact roller 44 and slide roller 46.

[Operation of the Variable Valve Mechanism]

Figure 2B:
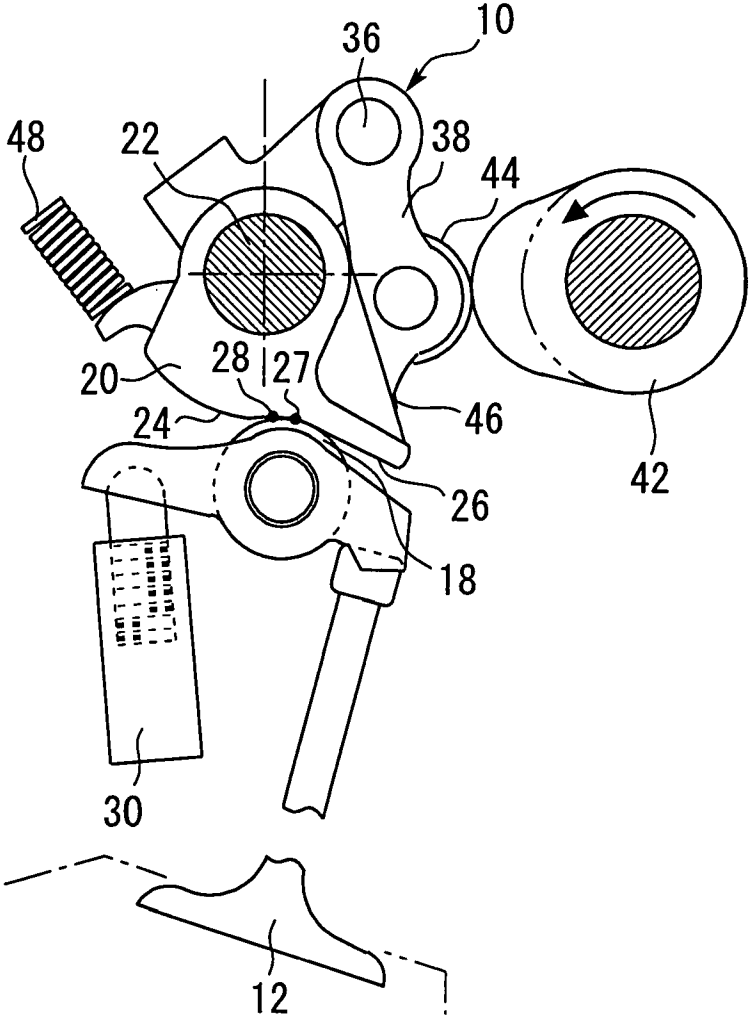
FIGS. 2A and 2B indicate that the variable valve mechanism shown in FIG. 1 operates to give a small lift to the valve disc.
Figure 2A:
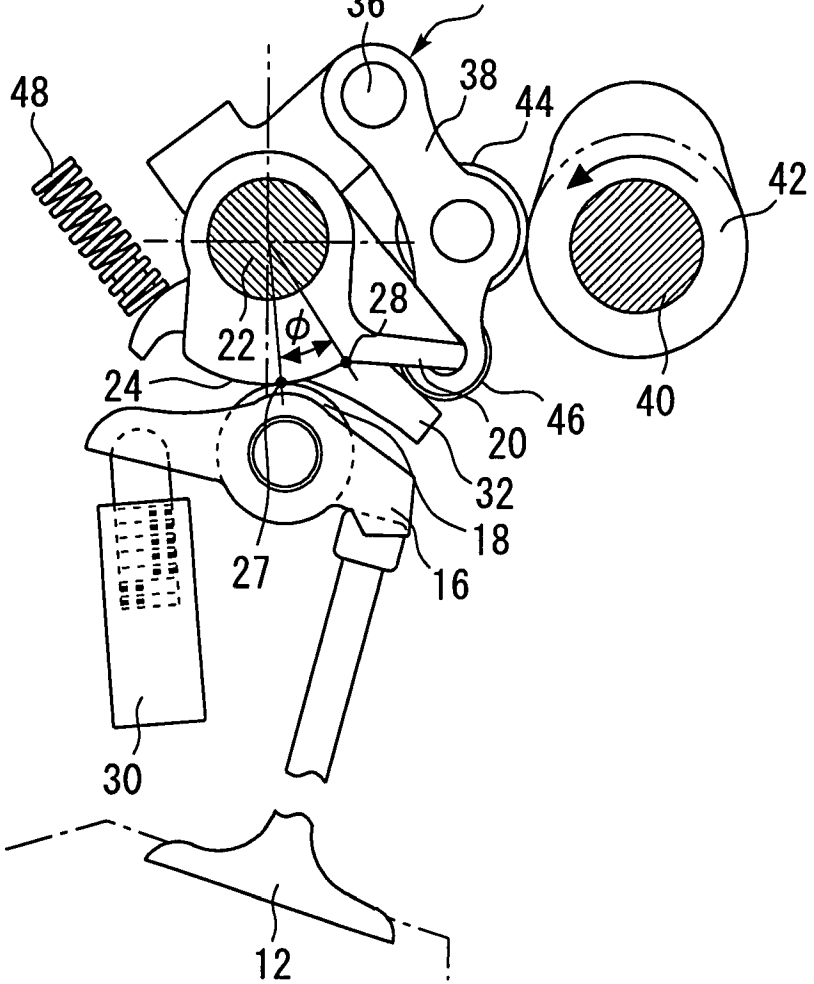

The operation of the variable valve mechanism 10 according to the first embodiment of the present invention will now be described with reference to FIGS. 2A, 2B, 3A, and 3B. FIGS. 2A and 2B indicate that the variable valve mechanism 10 operates to give a small lift to the valve disc 12. This operation is hereinafter referred to as a small lift operation. More specifically, FIG. 2A indicates that the valve disc 12 closes during a small lift operation process, and FIG. 2B indicates that the valve disc 12 opens during a small lift operation process.

In a state shown in FIG. 2A, that is, in a state where no pressure is exerted by the cam 42, the angle formed between a straight line joining the roller contact point 27 to the axial center Q of the control shaft 22 and a straight line joining the lift start point 28 to the axial center Q of the control shaft 22 is defined as the reference arm rotation angle $\phi$.

In the variable valve mechanism 10, the rotation position of the oscillation arm 20, that is, the reference arm rotation angle $\phi$, is determined by the position of the slide roller 46. The position of the slide roller 46 is determined by the position of the rotation shaft 36 for the oscillation roller arm 38 and the position of the cam contact roller 44. While the cam contact roller 44 and cam 42 remain in contact with each other, the slide roller 46 moves upward as the degree of counterclockwise rotation of the control shaft 22 in FIG. 2 increases. In the variable valve mechanism 10, therefore, the greater the amount of counterclockwise rotation of the control shaft 22, the greater the reference arm rotation angle $\phi$.

In a state shown in FIG. 2A, the reference arm rotation angle $\phi$ is virtually maximized. The variable valve mechanism 10 is configured so that when the reference arm rotation angle $\phi$ is virtually maximized, the approximate center of the non-pushing section 24 of the oscillation arm 20 is in contact with the arm roller 18 of the rocker arm 16, thereby closing the valve disc 12.

When the cam 42 rotates in a state shown in FIG. 2A, the cam contact roller 44 is pressed by the cam nose to move toward the control shaft 22. The distance between the rotation shaft 36 of the control arm 34 and the slide roller 46 remains unchanged. Therefore, when the cam contact roller 44 moves toward the control shaft 22, the roller contact surface 32 is pressed downward by the slide roller 46, which rolls on the roller contact surface 32. Consequently, the oscillation arm 20 rotates clockwise in FIG. 2 so that the roller contact point 27 moves from the non-pushing section 24 to the pushing section 26.

In a small lift operation, the reference arm rotation angle $\phi$ is great as described above. Therefore, the maximum rotation angle of the oscillation arm 20, which arises during the rotation of the cam 42, is relatively small in a small lift operation. When the rotation angle of the oscillation arm 20 is maximized, the valve disc 12 is subjected to the maximum lift. As indicated in FIG. 2B, the variable valve mechanism 10 is configured so that when such a rotation angle of the oscillation arm 20 arises, the roller contact point 27 slightly enters the pushing section 26, thereby giving a slight lift to the valve disc 12. Therefore, when the above small lift operation is performed, the variable valve mechanism 10 can give a small lift to the valve disc 12 in synchronism with the rotation of the cam 42.

In the above instance, the period during which the force of the cam 42 actually presses the valve disc 12 downward, that is, the period (crank angle width) during which the cam 42 rotates to open the valve disc 12, is relatively small (this period is hereinafter referred to as the operating angle). Therefore, when a small lift operation is performed, the variable valve mechanism 10 can reduce the operating angle of the valve disc 12.

Figure 3B:
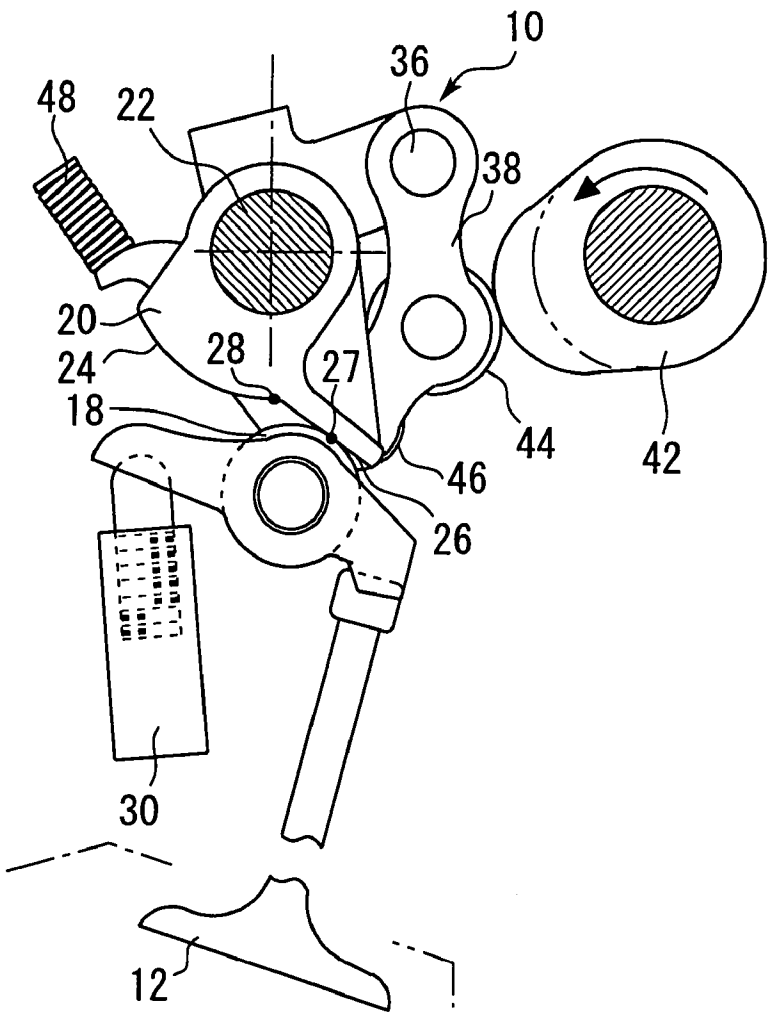
FIGS. 3A and 3B indicate that the variable valve mechanism shown in FIG. 1 operates to give a great lift to the valve disc.
Figure 3A:
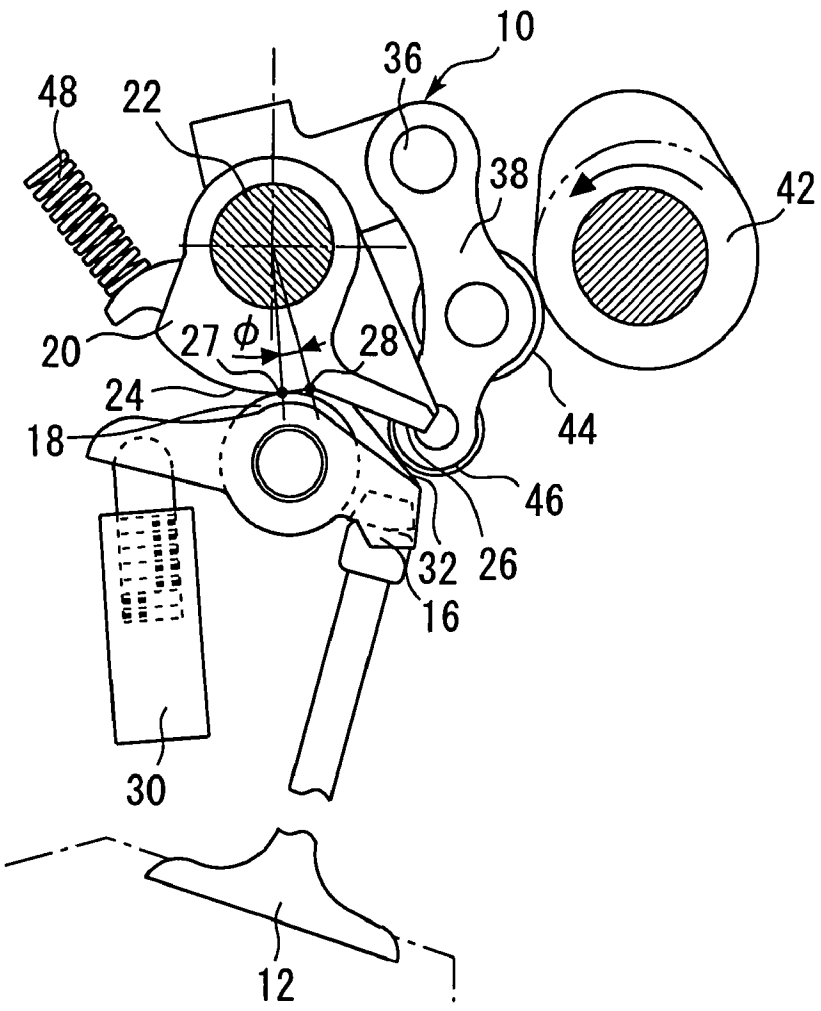

FIGS. 3A and 3B indicate that the variable valve mechanism 10 operates to give a great lift to the valve disc 12. This operation is hereinafter referred to as a great lift operation. More specifically, FIG. 3A indicates that the valve disc 12 closes during a great lift operation process, and FIG. 3B indicates that the valve disc 12 opens during a great lift operation process.

When a great lift operation is to be performed, the control shaft 22 is adjusted for a position that is rotated clockwise from a position prevailing during a small lift operation as indicated in FIG. 3A. Consequently, when a great lift operation is performed, the reference arm rotation angle $\phi$ is rendered sufficiently small without allowing the slide roller 46 to leave the roller contact surface 32. The variable valve mechanism 10 is configured so that when the reference arm rotation angle $\phi$ is sufficiently small, the roller contact point 27 is positioned near the lift start point 28 and toward the non-pushing section 24. Therefore, the valve disc 12 is also kept closed during a great lift operation.

When the cam 42 rotates in a state shown in FIG. 3A, the cam nose presses the cam contact roller 44 as indicated in FIG. 3B, thereby causing the oscillation arm 20 to rotate clockwise. Consequently, the roller contact point 27 moves from the non-pushing section 24 to the pushing section 26. When a great lift operation is performed, the reference arm rotation angle $\phi$ is rendered small as described above. Therefore, the maximum rotation angle of the oscillation arm 20, which arises when the cam 42 rotates, is great. As indicated in FIG. 3B, the variable valve mechanism 10 is configured so that when such a rotation angle of the oscillation arm 20 arises, the roller contact point 27 is sufficiently reached into the pushing section 26. As a result, when the above great lift operation is performed, the variable valve mechanism 10 can give a great lift and great operating angle to the valve disc 12 in synchronism with the rotation of the cam 42.

[Advantages of the Variable Valve Mechanism 10 According to the Present Embodiment]

As described above, the variable valve mechanism 10 according to the present embodiment can change the oscillation operation of the oscillation arm 20 (i.e. the reference arm rotation angle $\phi$) by changing the position of the control shaft 22, thereby changing the lift amount and operating angle of the valve disc 12. As described earlier, the variable valve mechanism 10 according to the present embodiment is configured so that the expansion/contraction direction of the lash adjuster 30 is parallel to a virtual straight line that joins the axial center Q of the control shaft 22 to the rotation center S of the arm roller 18. The advantages provided by such a configuration of the variable valve mechanism 10 will now be described with reference to FIG. 4.

Figure 4:
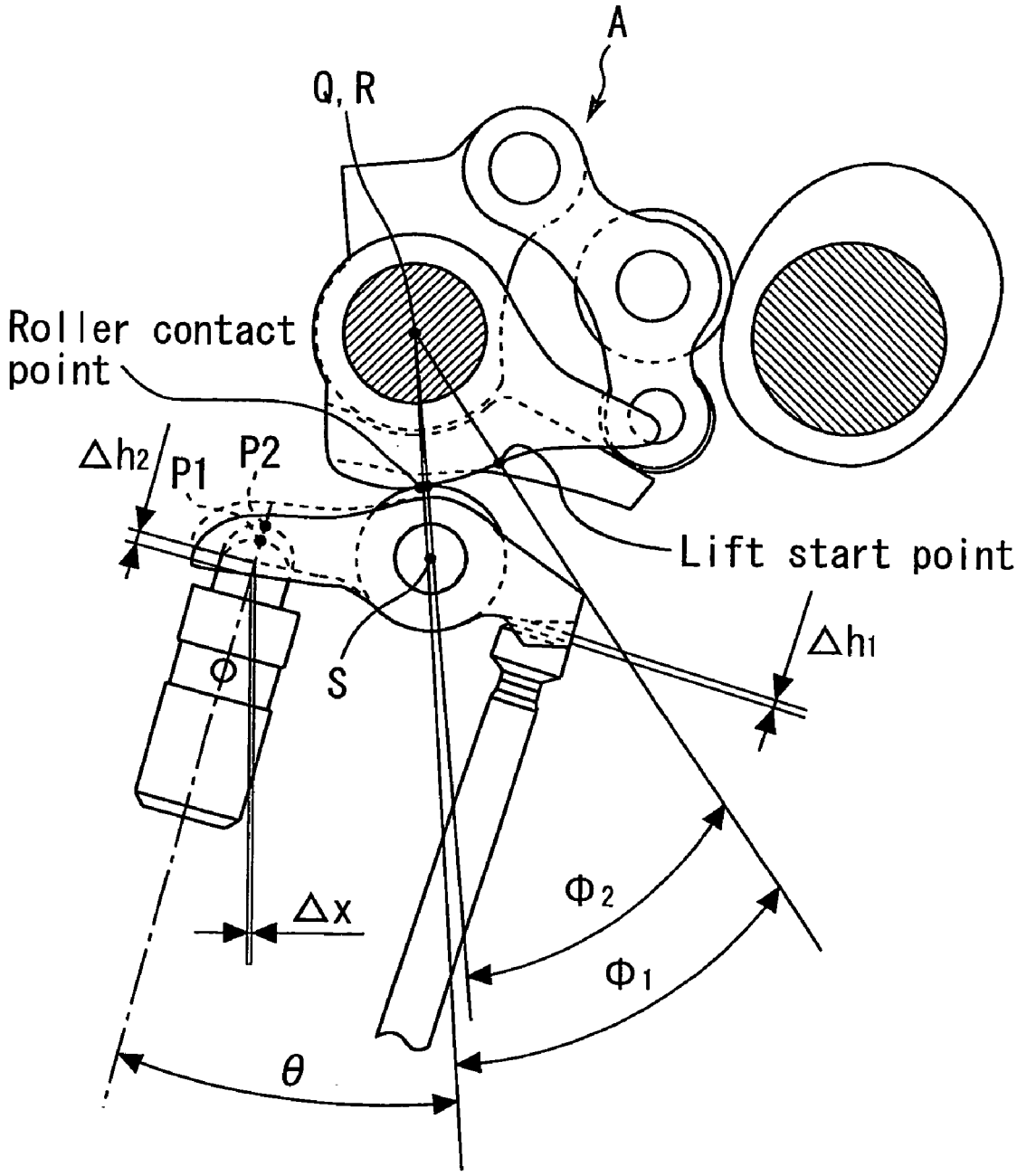
FIG. 4 illustrates a variable valve mechanism that is to be referenced for comparison with the configuration of the variable valve mechanism according to a first embodiment of the present invention.

FIG. 4 illustrates a variable valve mechanism that is to be referenced for comparison with the configuration of the variable valve mechanism 10 according to the present embodiment. Variable valve mechanism A, which is to be compared against the variable valve mechanism 10 according to the present embodiment, differs in lash adjuster position from the variable valve mechanism 10 according to the present embodiment. More specifically, variable valve mechanism A, which is shown in FIG. 4, is configured with no provision made so that the expansion/contraction direction of the lash adjuster is at a predetermined angle of $\theta$ to a virtual straight line joining the axial center Q of the control shaft to the rotation center S of the arm roller.

As indicated in FIG. 4, when variable valve mechanism A is used, a gap $\Delta h_1$ may arise between the end of the valve stem and the rocker arm due, for instance, to thermal expansion between the cylinder head and valve stem. When such a gap $\Delta h_1$ arises, the lash adjuster expands in order to reduce the gap $\Delta h_1$ to zero. If the amount of lash adjuster expansion is $\Delta h_2$, the rocker arm fulcrum P is displaced upward by $\Delta h_2$ (from fulcrum P1 to fulcrum P2) as indicated in FIG. 4 when the lash adjuster expands.

As described above, the above-mentioned angle $\theta$ is given to the lash adjuster of variable valve mechanism A. Therefore, when the rocker arm fulcrum P becomes displaced upward by $\Delta h_2$, it also becomes displaced horizontally by $\Delta x$ as indicated in FIG. 4. Consequently, the roller contact point 27 changes, that is, the reference arm rotation angle $\phi$ changes from $\phi_1$ to $\phi_2$. The amount of reference arm rotation angle $\phi$ change increases with an increase in the above-mentioned angle $\theta$, which is given to the lash adjuster, because the value $\Delta x$ increases with an increase in the above-mentioned angle $\theta$. A change in the reference arm rotation angle $\phi$ means that the lift amount and operating angle settings for the valve disc change. In other words, variable valve mechanism A is configured so that when the lash adjuster expands/contracts, the lift amount and operating angle of the valve disc vary from predefined values depending on the rotation position of the control shaft.

On the other hand, the variable valve mechanism 10 according to the present embodiment is configured so that the expansion/contraction direction of the lash adjuster 30 is parallel to a virtual straight line joining the axial center Q of the control shaft 22 to the rotation center S of the arm roller 18, that is, the above-mentioned angle $\theta$ is zero. Therefore, even when the fulcrum P of the rocker arm 16 is displaced due to expansion/contraction of the lash adjuster 30, the configuration according to the present embodiment ensures that the displacement direction of the fulcrum P is parallel to a virtual straight line joining the axial center Q of the control shaft 22 to the rotation center S of the arm roller 18. Thus, it is possible to effectively suppress a change in the reference arm rotation angle ϕ. As such being the case, the above-mentioned angle θ, which is to be given to the lash adjuster 30, should be close to zero wherever possible and at most 10° or less to ensure that the virtual straight line is substantially parallel to the axis line of the lash adjuster 30.

As described above, the variable valve mechanism 10 according to the present embodiment makes it possible to avoid an unexpected change in the operating angle and lift amount of the valve disc when the lash adjuster 30 expands/contracts. Further, the variable valve mechanism 10 according to the present embodiment controls the intake air amount by changing the lift amount and operating angle of the valve disc 12. It is therefore required that the accuracy in the lift amount/operating angle control of the valve disc 12 be higher than in a case where the employed internal combustion engine has an ordinary valve mechanism. When the configuration according to the present embodiment is employed, it is possible to provide a variable valve mechanism that meets the above requirements.

Figure 5A:
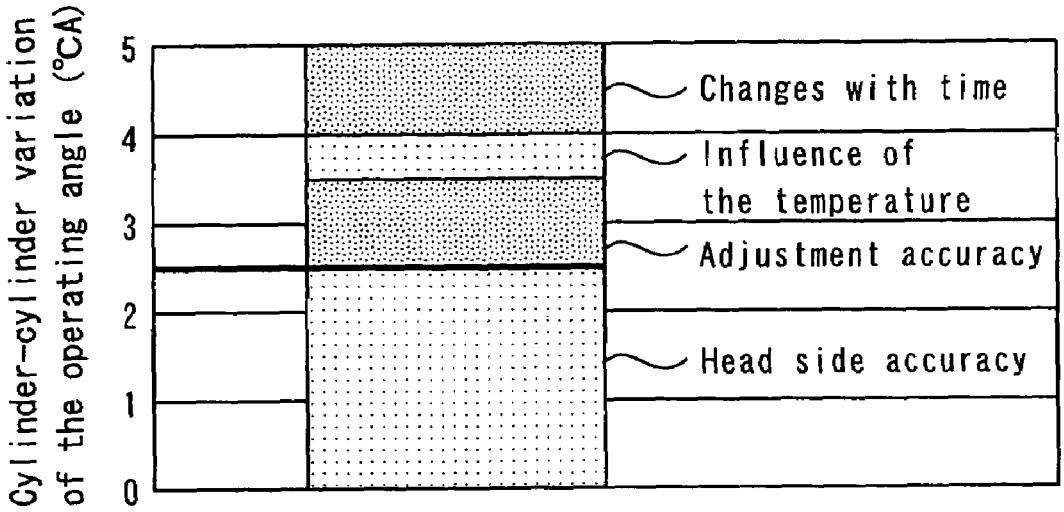
FIGS. 5A and 5B illustrate the permissible angle range for the lash adjuster in the variable valve mechanism according to a first embodiment of the present invention.
Figure 5B:
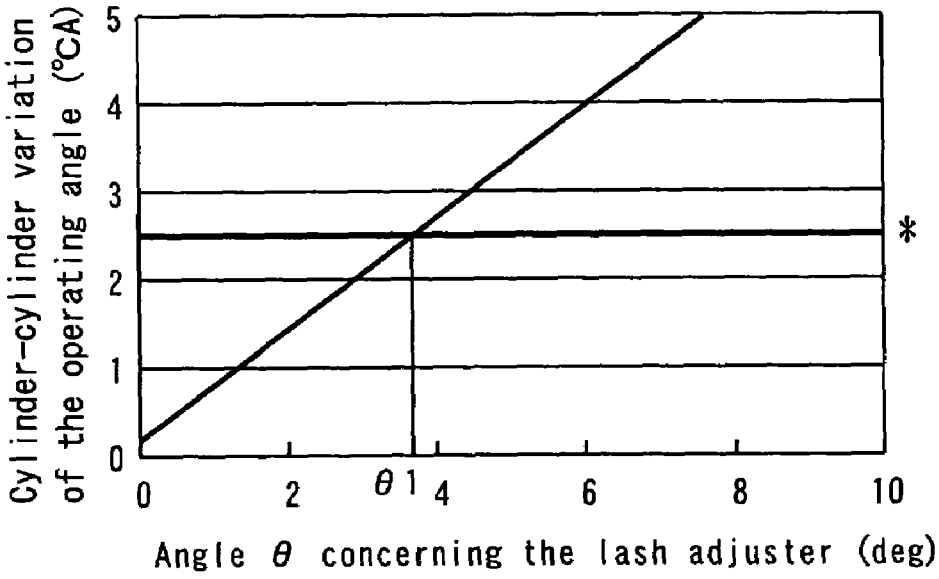

Advantages provided by the configuration according to the present embodiment will now be described in detail with reference to FIGS. 5A and 5B. FIGS. 5A and 5B illustrate the permissible angle θ range for the lash adjuster 30 in the variable valve mechanism 10 according to the first embodiment. More specifically, FIG. 5A shows the causes of cylinder-to-cylinder variation of the valve disc operating angle in the variable valve mechanism 10. FIG. 5B shows the relationship between the cylinder-to-cylinder variation of the operating angle and the angle θ concerning the lash adjuster 30.

As described earlier, a change in the reference arm rotation angle ϕ of the oscillation arm 20, that is, the positional displacement of the roller contact point 27, causes a change in the operating angle and lift amount of the valve disc 12. Therefore, if the positional displacement amount of the roller contact point 27 varies from one cylinder to another, the operating angle and lift amount of the valve disc 12 also vary from one cylinder to another.

Probable causes for mechanically invoking the cylinder-to-cylinder variations in the valve opening characteristics (operating angle, lift amount, valve opening timing, etc.) of the valve disc 12 are indicated in FIG. 5A. For explanation purposes, the following description deals with the operating angle. First of all, the cylinder-to-cylinder variation in the operating angle may be caused by the head side accuracy. The head side accuracy is determined by the machining accuracy and assembling accuracy of members whose positions are stipulated by the cylinder head, that is, the valve disc 12, valve stem 14, stem end cap 15, rocker arm 16, lash adjuster 30, and the like. More specifically, the cylinder-to-cylinder operating angle variation arising out of the head side accuracy occurs because, for instance, the height of the valve stem 14 and the position of the arm roller 18 relative to the fulcrum P of the rocker arm 16 vary from one cylinder to another.

As indicated in FIG. 5A, the other causes for invoking the cylinder-to-cylinder operating angle variation are adjustment accuracy, influence of temperature, and changes with time. The adjustment accuracy relates to the relative positions of various members to be positioned above the rocker arm 16, that is, the oscillation arm 20, control shaft 22, control arm 34, oscillation roller arm 38, and camshaft 40. The cylinder-to-cylinder operating angle variation invoked by the influence of temperature occurs when the thermal expansion of components varies from one cylinder to another due, for instance, to engine cooling water circulation path layout. The cylinder-to-cylinder operating angle variation invoked by changes with time occurs when the wear of sliding parts of various members, such as the arm roller 18 and slide roller 46, varies from one cylinder to another.

In an internal combustion engine in which the intake air amount is controlled mainly by allowing the variable valve mechanism to change the valve opening characteristics of the valve disc as is the case with the variable valve mechanism 10 according to the present embodiment, intake air amount control is greatly affected by the cylinder-to-cylinder operating angle (valve disc's valve opening characteristic) variation particularly in a low load region, that is, in a region where the operating angle and lift amount of the valve disc are minutely controlled. In other words, it is required that such a region be accurately controlled to reduce the cylinder-to-cylinder intake air amount variation.

In FIG. 5A, the numerical values representing cylinder-to-cylinder operating angle variations indicate an example of target values for the operating angle variation that is permissible in an actual internal combustion engine. When the cylinder-to-cylinder intake air amount variation increases in an internal combustion engine, the torque variation increases. Consequently, it is difficult to operate the internal combustion engine at a lean air-fuel ratio. Therefore, the fuel efficiency cannot be improved. The above-mentioned permissible operating angle variation values are called for in order to ensure that the internal combustion engine properly operates. To comply with engine requirements, the example in FIG. 5A indicates that the permissible operating angle variation value needs to be smaller than 5° CA for the combination of all the above-mentioned causes for the cylinder-to-cylinder operating angle variation and approximately 2.5° CA for the cause of head side accuracy.

If, for instance, the valve height differs between cylinders by a certain value, the greater the angle θ concerning the lash adjuster 30, the greater the degree of positional displacement of the roller contact point 27, which is caused by lash adjuster expansion/contraction, that is, the greater the change in the operating angle of the valve disc 12 as indicated in FIG. 5B. Therefore, the cylinder-to-cylinder operating angle variation increases. Angle θ1, which is indicated in FIG. 5B, is an angle that corresponds to the above-mentioned permissible operating angle variation value. In the example shown in FIG. 5B, angle θ1 is approximately 3.5°. The range within which the angle θ concerning the lash adjuster 30 is between 0 and θ1 is an angular range within which the cylinder-to-cylinder operating angle variation is not greater than the permissible operating angle variation value. In other words, when the angle θ setting is within the above angular range, that is, when the angle θ setting is such that the axis line of the lash adjuster 30 is substantially parallel to a virtual straight line joining the axial center Q of the control shaft 22 (the rotation center Q of the oscillation arm 20) to the rotation center S of the arm roller 18, it is possible to ensure that the cylinder-to-cylinder operating angle variation is not greater than the permissible operating angle variation value.

In the first embodiment, which has been described above, the variable valve mechanism 10 is configured so that the rotation center Q of the oscillation arm 20 coincides with the curvature center R of the non-pushing section (non-pushing surface) 24. However, the present invention is not limited to such a configuration. In an alternative configuration to which the present invention is applicable, the rotation center Q of the oscillation arm does not have to coincide with the curvature center R of the non-pushing section (non-pushing surface) as far as the axis line of the lash adjuster 30 is substantially parallel to a virtual straight line that joins the curvature center R of the non-pushing surface 24 to the rotation center S of the arm roller 18 as viewed in the direction of the axis of the camshaft 40. Further, even if the rotation center Q of the oscillation arm does not coincide with the curvature center R of the non-pushing surface, the advantages of the present invention are properly provided as far as the axis line of the lash adjuster 30 is substantially parallel to a virtual straight line that joins the curvature center R of the non-pushing surface to the rotation center S of the arm roller as viewed in the direction of the axis of the camshaft 40. More specifically, it is possible to avoid an unexpected change in the valve opening characteristics of the valve disc when the lash adjuster expands/contracts, and inhibit the valve opening characteristics of the valve disc from varying from one cylinder to another when the lash adjuster expands/contracts. Furthermore, the first embodiment assumes that the control shaft 22 retains the oscillation arm 20 in such a manner as to permit the oscillation arm 20 to oscillate. However, the present invention is not limited to such an oscillation arm configuration. More specifically, the oscillation arm may turn on a shaft other than the control shaft.

In the first embodiment, which has been described above, the control shaft 22, roller contact surface 32, control arm 34, and oscillation roller arm 38 correspond to the adjustment mechanism according to the first or second aspect of the present invention.

Second Embodiment

A second embodiment of the present invention will now be described with reference to FIGS. 6 through 8.

Figure 6:
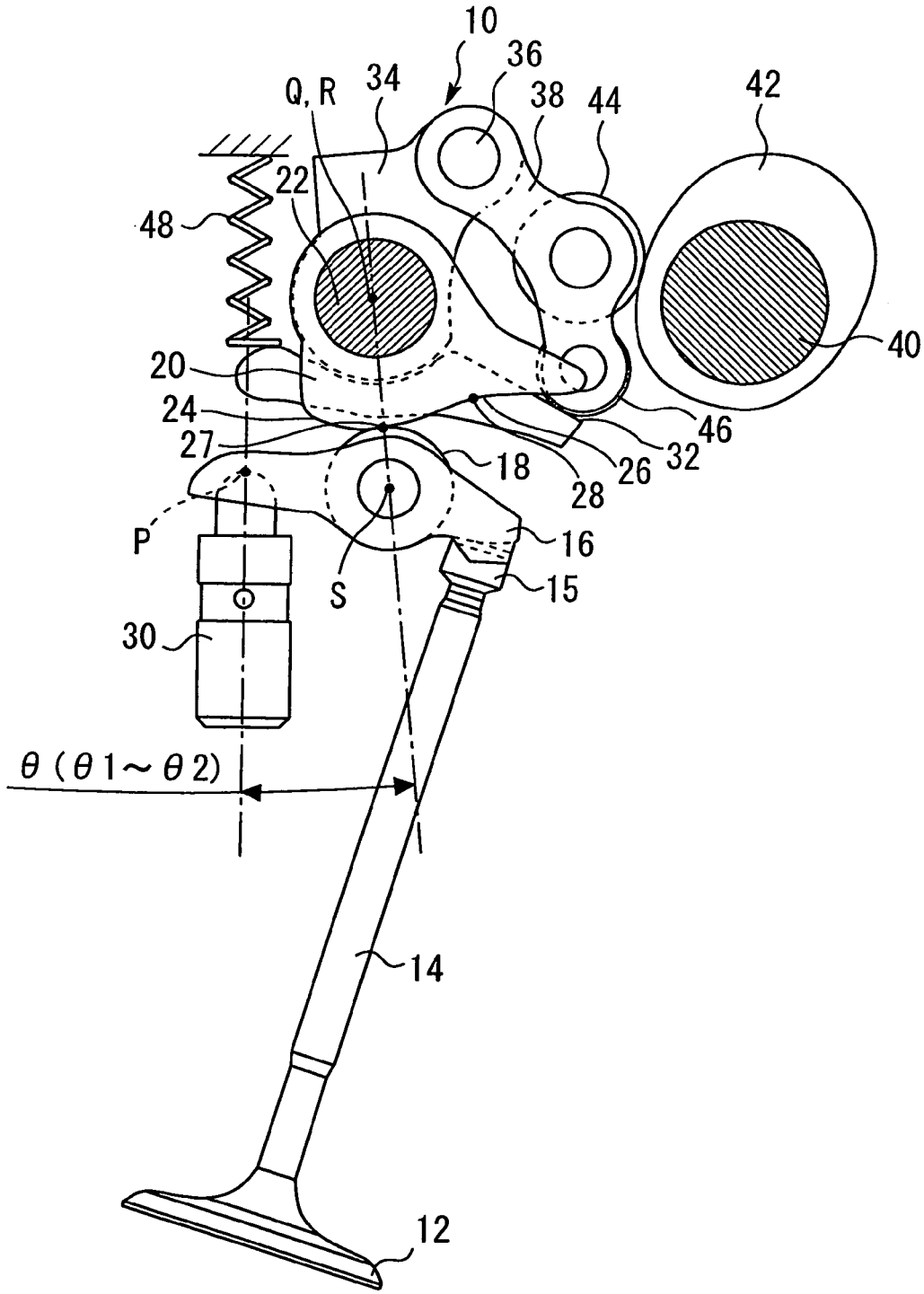
FIG. 6 illustrates the configuration of a variable valve mechanism according to a second embodiment of the present invention.

FIG. 6 illustrates the configuration of a variable valve mechanism 50 according to the second embodiment of the present invention. Like elements in FIGS. 1 and 6 are assigned the same reference numerals and will be briefly described or will not be described at all.

The variable valve mechanism 50 according to the second embodiment is configured the same as the variable valve mechanism 10 according to the first embodiment, which has been described earlier, except that the stem end cap 15 is used as the valve height adjuster for adjusting the height of the valve stem 14, and that the angle θ concerning the lash adjuster 30 is within the permissible operating angle variation value range (within the range of θ1 to θ2 as described later).

As described earlier, the cylinder-to-cylinder operating angle variation arising out of head side accuracy occurs when, for instance, the height of the valve stem 14 varies from one cylinder to another. The present embodiment assumes that the cylinder-to-cylinder axis length variation of the valve stem 14 is smoothed out by allowing the stem end cap 15 to adjust the valve height. More specifically, the valve height adjustment is made by preparing several types of stem end caps 15 that slightly differ in thickness, and selecting a stem end cap 15 having an appropriate thickness for each cylinder to ensure that each of the valve stem 14 of the cylinders have the same valve stem height when a process is performed to mount various component members on a cylinder head.

[Advantages of the Variable Valve Mechanism 50 According to the Present Embodiment]

Figure 7:
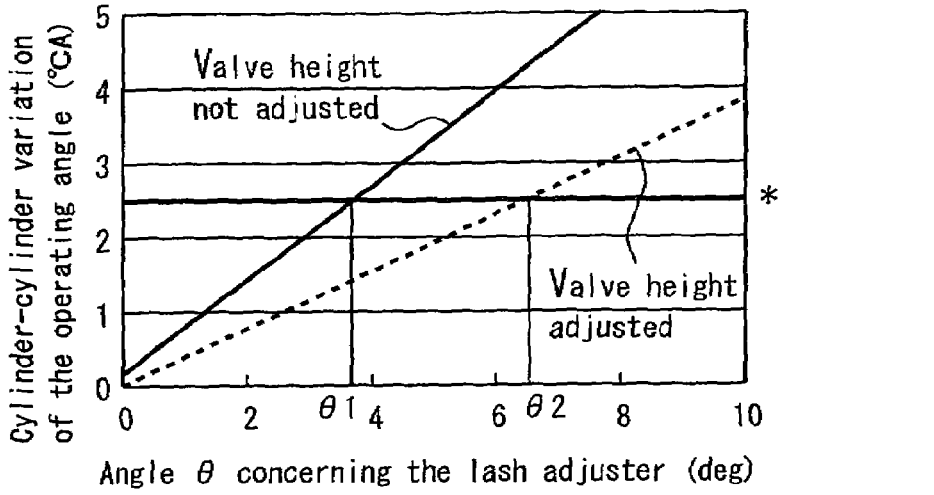
FIG. 7 illustrates the permissible angle range for the lash adjuster in the variable valve mechanism 50 according to a second embodiment of the present invention.

FIG. 7 illustrates the permissible angle θ range for the lash adjuster 30 in the variable valve mechanism 50 according to the second embodiment. In FIG. 7, a solid straight line indicates a relationship prevailing when valve height adjustments are not made by the stem end cap 15, whereas a broken straight line indicates a relationship prevailing when such valve height adjustments are made.

Angle θ2, which is shown in FIG. 7, corresponds to a permissible operating angle variation value that meets engine requirements when the height of the valve stem 14 is adjusted. In an example shown in FIG. 7, angle θ2 is approximately 7°. When the height of the valve stem 14 is adjusted in the above manner, it is possible to eliminate the cylinder-to-cylinder operating angle variation caused by the cylinder-to-cylinder valve stem height variation, which is one of the cylinder-to-cylinder operating angle variations caused by the head side accuracy. Therefore, the angle θ range for complying with the permissible operating angle variation value can be increased from θ1 to θ2. As described above, the angle θ concerning the lash adjuster 30 in the variable valve mechanism 50 is set within a range within which the cylinder-to-cylinder operating angle variation is not greater than the permissible operating angle variation value. Therefore, the variable valve mechanism 50 according to the present embodiment provides an increased degree of freedom in determining the mounting angle of the lash adjuster 30 on the cylinder head.

Figure 8:
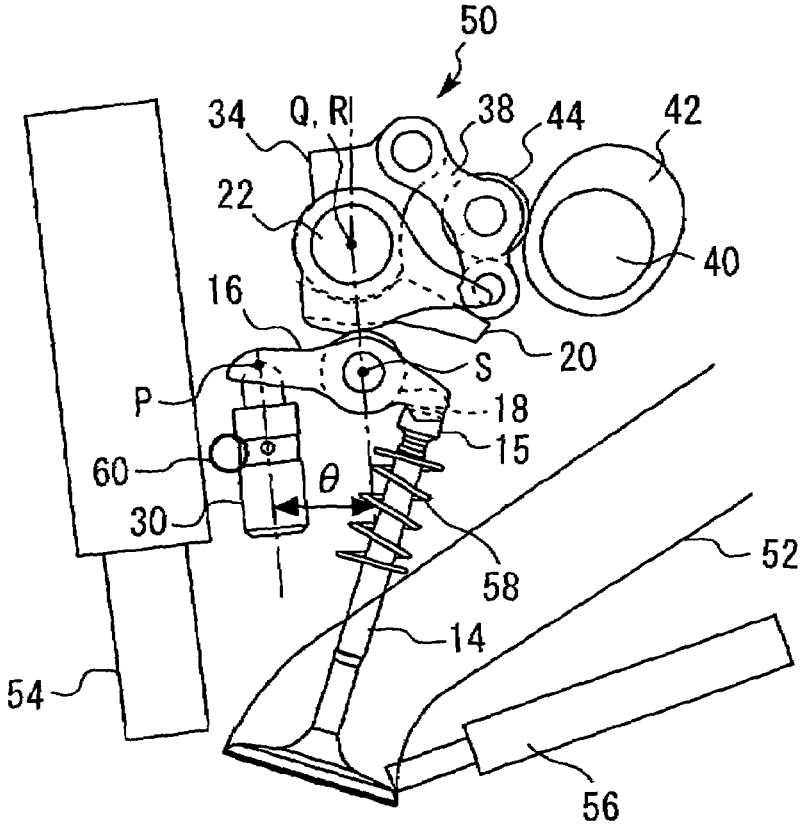
FIG. 8 illustrates an example of a layout of an internal combustion engine that is to be referenced for explaining the merit of the configuration according to a second embodiment of the present invention.

The configuration of the variable valve mechanism 50 according to the present embodiment is particularly effective for an internal combustion engine in which the degree of freedom in determining the mounting angle of the lash adjuster 30 is limited as indicated in the internal combustion engine illustration in FIG. 8. FIG. 8 illustrates a typical layout of such an internal combustion engine. FIG. 8 shows an intake system layout of an intra-cylinder injection type internal combustion engine. Even when the variable valve mechanism 50 is not applied to an intra-cylinder injection type internal combustion engine, the variable valve mechanism 50 needs to be positioned in a narrow space between an intake port 52 and a spark plug hole 54, in which a spark plug is placed. For an intra-cylinder injection type internal combustion engine, a fuel injector 56 is of ten positioned below the intake port 52. Therefore, the space for positioning the variable valve mechanism 50 is further limited. Further, the lash adjuster 30 needs to be positioned in a space that does not interfere with a valve spring 58. If the lash adjuster 30 receives an oil supply from the outside, the interior of the cylinder head needs to be provided with an oil hole 60 for oil supply. As described above, the angle of mounting the lash adjuster 30 on the cylinder head is variously limited by surrounding members.

As such being the case, a method for moving the axial center Q of the control shaft 22 might be used to ensure that the axis line of the lash adjuster 30 whose mounting angle is limited as described above is parallel to a virtual straight line joining the axial center Q of the control shaft 22 to the rotation center S of the arm roller 18. However, when the axial center Q of the control shaft 22 moves, the axial center of the camshaft 40 also moves. If a change in the distance between the axis center of the intake camshaft and the axis center of the exhaust camshaft is limited, the axial center of the camshaft 40 cannot be moved arbitrarily. If the camshaft 40 is moved out of the cylinder head, the cylinder head section frame enlarges.

Even when the employed internal combustion engine is limited as described above, the variable valve mechanism 50 according to the present embodiment adjusts the height of the valve stem 14, which serves as an intake valve, and performs setup so that the above angle θ is within a permissible operating angle variation range, thereby making it possible to provide an effective degree of freedom in determining the angle of mounting the lash adjuster 30 on the cylinder head and inhibiting the cylinder-to-cylinder operating angle variation from exceeding a value for satisfying engine requirements.

The major features and benefits of the present invention described above are summarized as follows:

The first aspect of the present invention includes a variable valve mechanism which includes a rocker arm, one end of which is in contact with a non-valve-disc lateral end of a valve stem, the other end of which functions as a fulcrum, and the central portion of which is provided with an arm roller. A lash adjuster that expands and contracts to provide zero tappet clearance and is positioned to support the fulcrum of said rocker arm is provided. An oscillation arm that has an oscillation cam surface for coming into contact with the arm roller and oscillates in synchronism with the rotation of a cam, thereby transmitting the pressure of the cam to the rocker arm is further provided. An adjustment mechanism for changing the reference arm rotation angle of the oscillation arm in relation to the rocker arm with a view toward changing the operating angle and/or lift amount of a valve disc within a predetermined adjustment range is further provided. The axis line of the lash adjuster is substantially parallel to a virtual straight line that joins the rotation center of the oscillation arm to the rotation center of the arm roller.

The second aspect of the present invention may include a variable valve mechanism which includes a control shaft that is driven by an actuator. An adjustment mechanism is provided for changing the valve opening characteristics of a valve disc relative to the rotation of a camshaft in accordance with the position of the control shaft. A rocker arm, one end of which is in contact with a non-valve-disc lateral end of a valve stem, the other end of which functions as a fulcrum, and the central portion of which is provided with an arm roller is further provided. A lash adjuster that expands and contracts to provide zero tappet clearance and is positioned to support the fulcrum of the rocker arm is further provided. An oscillation member that has an oscillation cam surface, which includes a non-pushing surface having a fixed curvature, for coming into contact with the arm roller and oscillates in synchronism with the rotation of a cam, thereby transmitting the pressure of the cam to the rocker arm is further provided. The axis line of the lash adjuster is substantially parallel to a virtual straight line that joins the curvature center of the non-pushing surface to the rotation center of the arm roller as viewed in the direction of the axis of the camshaft.

The third or fourth aspect of the present invention may include a valve height adjuster for adjusting the height of the valve stem. The angle between the virtual straight line and the axis line of the lash adjuster may be set within a range within which the cylinder-to-cylinder variations of the valve opening characteristics of the valve disc do not exceed a permissible variation value.

According to the first aspect of the present invention, when the lash adjuster expands/contracts, the present aspect of the invention effectively inhibits the point of contact between the oscillation cam surface and arm roller from changing, that is, effectively suppresses a change in the reference arm rotation angle of the oscillation arm. As a result, the present invention makes it possible to avoid an unexpected change in the operating angle and/or lift amount of the valve disc when the lash adjuster expands/contracts. Further, when the lash adjuster expands/contracts, the present invention inhibits the valve opening characteristics of the valve disc from varying from one cylinder to another due, for instance, to the machining accuracy and assembling accuracy of variable valve mechanism components.

According to the second aspect of the present invention, when the lash adjuster expands/contracts, the present aspect of the invention effectively inhibits the point of contact between the oscillation cam surface and arm roller from changing. As a result, the present invention makes it possible to avoid an unexpected change in the valve opening characteristics of the valve disc when the lash adjuster expands/contracts. Further, when the lash adjuster expands/contracts, the present invention inhibits the valve opening characteristics of the valve disc from varying from one cylinder to another due, for instance, to the machining accuracy and assembling accuracy of variable valve mechanism components.

According to the third or fourth aspect of the present invention, the present aspect of the invention makes it possible to inhibit the cylinder-to-cylinder variation of the valve opening characteristics of the valve disc from exceeding a value for satisfying engine requirements while providing an effective degree of freedom in determining the mounting angle of the lash adjuster in an internal combustion engine.

Further, the present invention is not limited to these embodiments, but variations and modifications may be made without departing from the scope of the present invention.

The invention claimed is:

1. A variable valve mechanism comprising:

a rocker arm, one end of which is in contact with a non-valve-disc lateral end of a valve stem, the other end of which functions as a fulcrum, and the central portion of which is provided with an arm roller;

a lash adjuster that expands and contracts to provide zero tappet clearance and is positioned to support the fulcrum of said rocker arm;

an oscillation arm that has an oscillation cam surface for coming into contact with said arm roller and oscillates in synchronism with the rotation of a cam, thereby transmitting the pressure of the cam to said rocker arm; and an adjustment mechanism for changing the reference arm rotation angle of said oscillation arm in relation to said rocker arm with a view toward changing the operating angle and/or lift amount of a valve disc within a predetermined adjustment range, wherein the axis line of said lash adjuster is substantially parallel to a virtual straight line that joins the rotation center of said oscillation arm to the rotation center of said arm roller throughout operation of the adjustment mechanism.

2. A variable valve mechanism comprising:

a control shaft that is driven by an actuator;

an adjustment mechanism for changing the valve opening characteristics of a valve disc relative to the rotation of a camshaft in accordance with the position of said control shaft;

a rocker arm, one end of which is in contact with a non-valve-disc lateral end of a valve stem, the other end of which functions as a fulcrum, and the central portion of which is provided with an arm roller;

a lash adjuster that expands and contracts to provide zero tappet clearance and is positioned to support the fulcrum of said rocker arm; and an oscillation member that has an oscillation cam surface, which includes a non-pushing surface having a fixed curvature, for coming into contact with said arm roller and oscillates in synchronism with the rotation of a cam, thereby transmitting the pressure of the cam to said rocker arm, wherein the axis line of said lash adjuster is substantially parallel to a virtual straight line that joins the curvature center of said non-pushing surface to the rotation center of said arm roller as viewed in the direction of the axis of said camshaft throughout operation of the adjustment mechanism.

3. The variable valve mechanism according to claim 1, further comprising:

a valve height adjuster for adjusting the height of said valve stem, wherein the angle between said virtual straight line and the axis line of said lash adjuster is set within a range within which the cylinder-to-cylinder variations of the valve opening characteristics of the valve disc do not exceed a permissible variation value.

4. The variable valve mechanism according to claim 2, further comprising:

a valve height adjuster for adjusting the height of said valve stem, wherein the angle between said virtual straight line and the axis line of said lash adjuster is set within a range within which the cylinder-to-cylinder variations of the valve opening characteristics of the valve disc do not exceed a permissible variation value.

* * * * *